US006762662B2

(12) United States Patent
Lee et al.

(10) Patent No.: US 6,762,662 B2
(45) Date of Patent: Jul. 13, 2004

(54) HERMETICALLY SEALED ELECTRICAL SWITCH ASSEMBLY

(76) Inventors: Wen-Fong Lee, No. 13-2, Lane 79, Sec. 1, Taichung Kang Rd., Taichung (TW); Ming-Hung Lee, No. 13-2, Lane 79, Sec. 1, Taichung Kang Rd., Taichung (TW); Ming-Tung Lee, No. 13-2, Lane 79, Sec. 1, Taichung Kang Rd., Taichung (TW); Ming-Yu Lee, No. 13, Lane 79, Sec. 1, Taichung Kang Rd., Taichung (TW)

( * ) Notice: Subject to any disclaimer, the term of this patent is extended or adjusted under 35 U.S.C. 154(b) by 232 days.

(21) Appl. No.: 09/987,422

(22) Filed: Nov. 14, 2001

(65) Prior Publication Data

US 2003/0090352 A1 May 15, 2003

(51) Int. Cl.[7] ..... H01H 35/14
(52) U.S. Cl. ..... 335/2; 335/202
(58) Field of Search ..... 335/2, 202

(56) References Cited

U.S. PATENT DOCUMENTS

| | | | | | |
|---|---|---|---|---|---|
| 3,771,153 | A | * | 11/1973 | Byrne | 340/547 |
| 4,025,885 | A | * | 5/1977 | Giannini | 335/154 |
| 4,288,767 | A | * | 9/1981 | Lee | 335/6 |
| 4,739,291 | A | | 4/1988 | Lee | |
| 4,814,565 | A | * | 3/1989 | Bingo et al. | 200/548 |
| 4,841,109 | A | * | 6/1989 | Sakakino et al. | 200/302.1 |
| 5,323,131 | A | * | 6/1994 | Castonguay | 335/68 |
| 5,693,923 | A | * | 12/1997 | Gula et al. | 200/50.26 |
| 5,777,536 | A | | 7/1998 | Lee et al. | |
| 5,808,532 | A | * | 9/1998 | DiVincenzo et al. | 335/68 |
| 5,844,184 | A | * | 12/1998 | Liau | 200/16 R |
| 6,008,458 | A | * | 12/1999 | Domzalski et al. | 200/302.1 |
| 6,577,214 | B1 | * | 6/2003 | DeGrazia et al. | 335/68 |
| 2003/0016106 | A1 | * | 1/2003 | Woods | 335/207 |

FOREIGN PATENT DOCUMENTS

| | | | | | |
|---|---|---|---|---|---|
| CH | 565445 | A | * | 8/1975 | H01H/36/00 |
| DE | 3545149 | A | * | 8/1987 | H01H/36/00 |
| FR | 2444530 | A | * | 8/1980 | B23K/9/10 |
| FR | 2451093 | A | * | 11/1980 | H01H/1/66 |

* cited by examiner

*Primary Examiner*—Lincoln Donovan
*Assistant Examiner*—Bernard Rojas
(74) *Attorney, Agent, or Firm*—Browdy and Neimark, P.L.L.C.

(57) ABSTRACT

A hermetically sealed electrical switch assembly comprises a casing having an opening end. A cover is sealingly attached to said opening end of said casing for forming a primary volume hermetically sealed from external environment. Received in said primary volume are a switch means and a magnetic responsive means. A magnetic activating means is fitted at the upper surface of said cover for effecting the movement of said magnetic responsive means. The switch means comprises electrical contacts to change the conducting state of a power circuit with which said switch means is connected, a switching lever which can change its positions according to the conducting state of the power circuit. The magnetic responsive means couples with said switching lever for moving with it.

18 Claims, 6 Drawing Sheets

HERMETICALLY SEALED ELECTRICAL SWITCH ASSEMBLY

FIELD OF THE INVENTION

The present invention relates generally to electrical switches, and more particularly to a hermetically sealed electrical switch assembly having a low manufacture cost.

BACKGROUND OF THE INVENTION

In conventional electrical switches, especially those used in power circuits, the contacts are exposed to air. Corrosion of the components of these kinds of switches is liable to occur after the switches are used for a period of time, resulting in a poor sensitivity of the switches. In addition, such switches are not suitable for use in dust, moist, easily explosive or combustible environments. Several different types of switches for preventing explosions have been developed, such as oil switches, safety switches, and so forth. However, due to the complex structures of these switches, they are unpractical from a manufacturing standpoint. Accordingly, the inventors disclosed two types of automatic magnetic switches in the U.S. Pat. Nos. 4,739,291 and 5,777,536. The structures of these switches are simper than the conventional switches but still too complicated for manufacture. They are thus desirable to be further improved on the structures thereof.

SUMMARY OF THE INVENTION

It is therefore a primary object of the invention to provide a hermetically sealed electrical switch assembly, which is capable of being made to be waterproof, corrosion-proof, dustproof and explosion-proof to provide a more sensitive and safer operating.

Another object of the invention is to provide a simple hermetically sealed electrical switch assembly, which has a lower manufacture cost.

According to the present invention, the hermetically sealed electrical switch assembly comprises a casing having an opening end, a cover sealingly attached to said opening end of said casing to define a primary volume hermetically sealed from external environment, switch means received in said primary volume, magnetic responsive means arranged inside said primary volume, and magnetic activating means attached to the upper surface of said cover for effecting the movement of said magnetic responsive means. The switch means comprises electrical contacts to change the conducting state of a power circuit with which said switch means is connected. and a switching lever which can change its positions according to the conducting state of the power circuit. The magnetic responsive means couples with said switching lever for moving with it.

When the circuit said electrical switch assembly connected is in an over-loaded or short-circuit state, said switching lever of said switch means will switch automatically from a first (ON) position to a second (OFF) position. In the meantime, said magnetic responsive means will be forced by said switching lever to slide to the same way and said magnetic activating means will be forced to slide synchronously by the magnetic attractive force therebetween.

When said switch assembly is desired to be reset after the circuit is opened, User can push said magnetic activating means manually to force sliding to original position. In the meantime, said magnetic responsive means will slide synchronously to the same way by the magnetic attractive force and said switching lever will be forced to switch to the ON position.

BRIEF DESCRIPTION OF THE DRAWINGS

Other features and advantages of this invention will become apparent in the following detailed description of the preferred embodiments of the invention with reference to the accompanying drawings, in which.

DETAIL DESCRIPTION OF THE INVENTION

Figure 1:
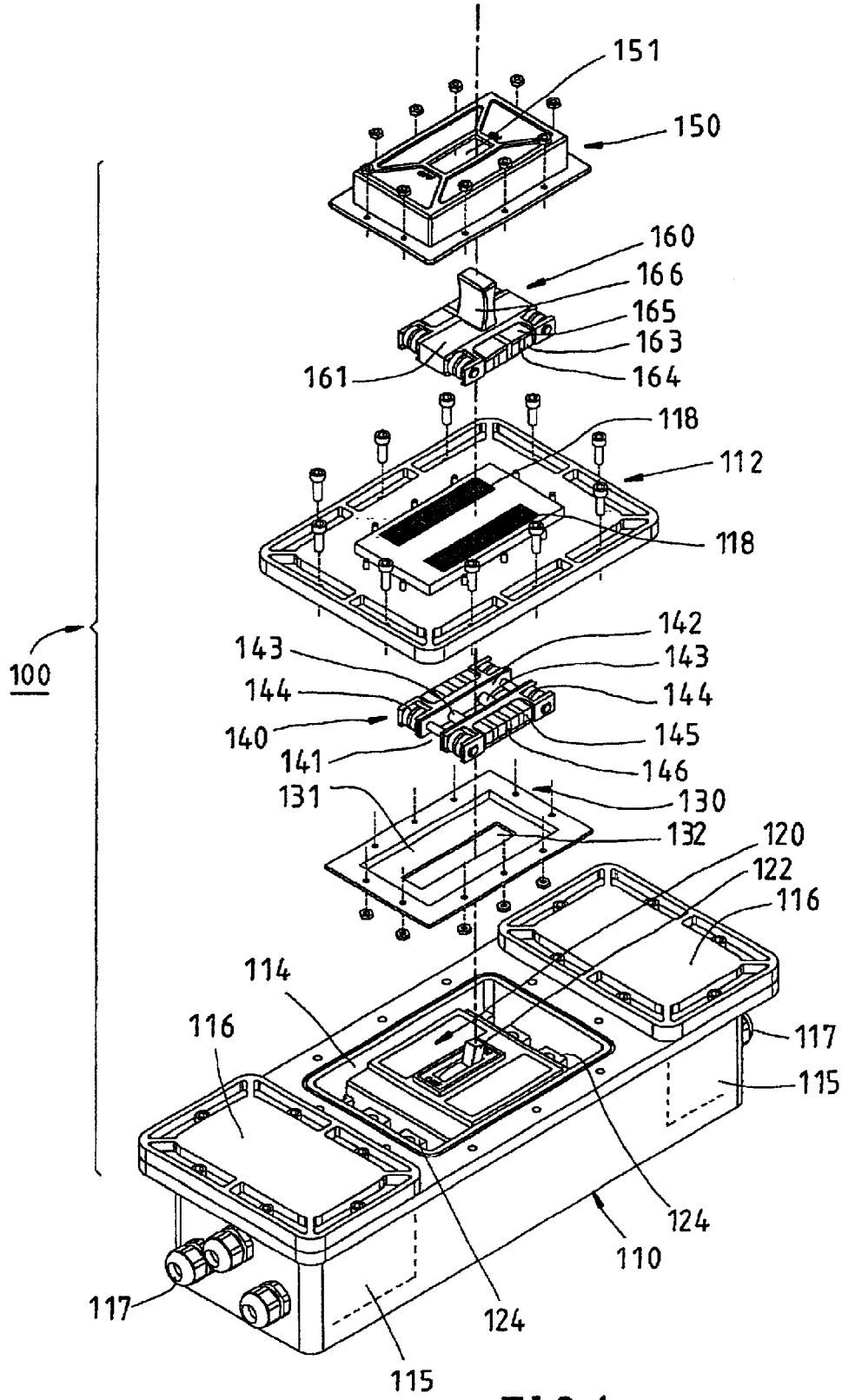
FIG. 1 is a perspective exploded view of a preferred embodiment of a hermetically sealed electrical switch assembly according the present invention.
Figure 2:
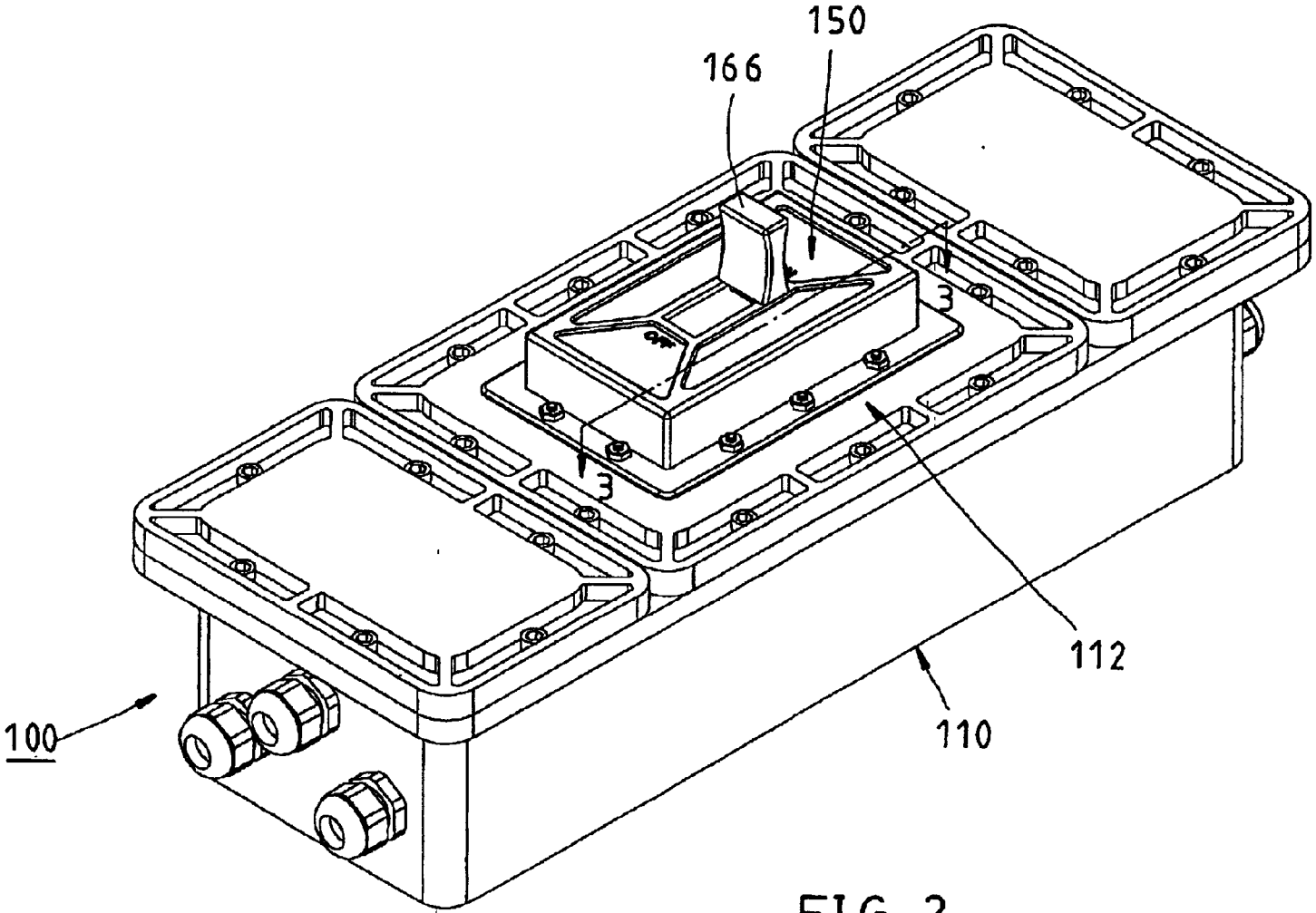
FIG. 2 is a perspective view of the preferred embodiment.
Figure 3:
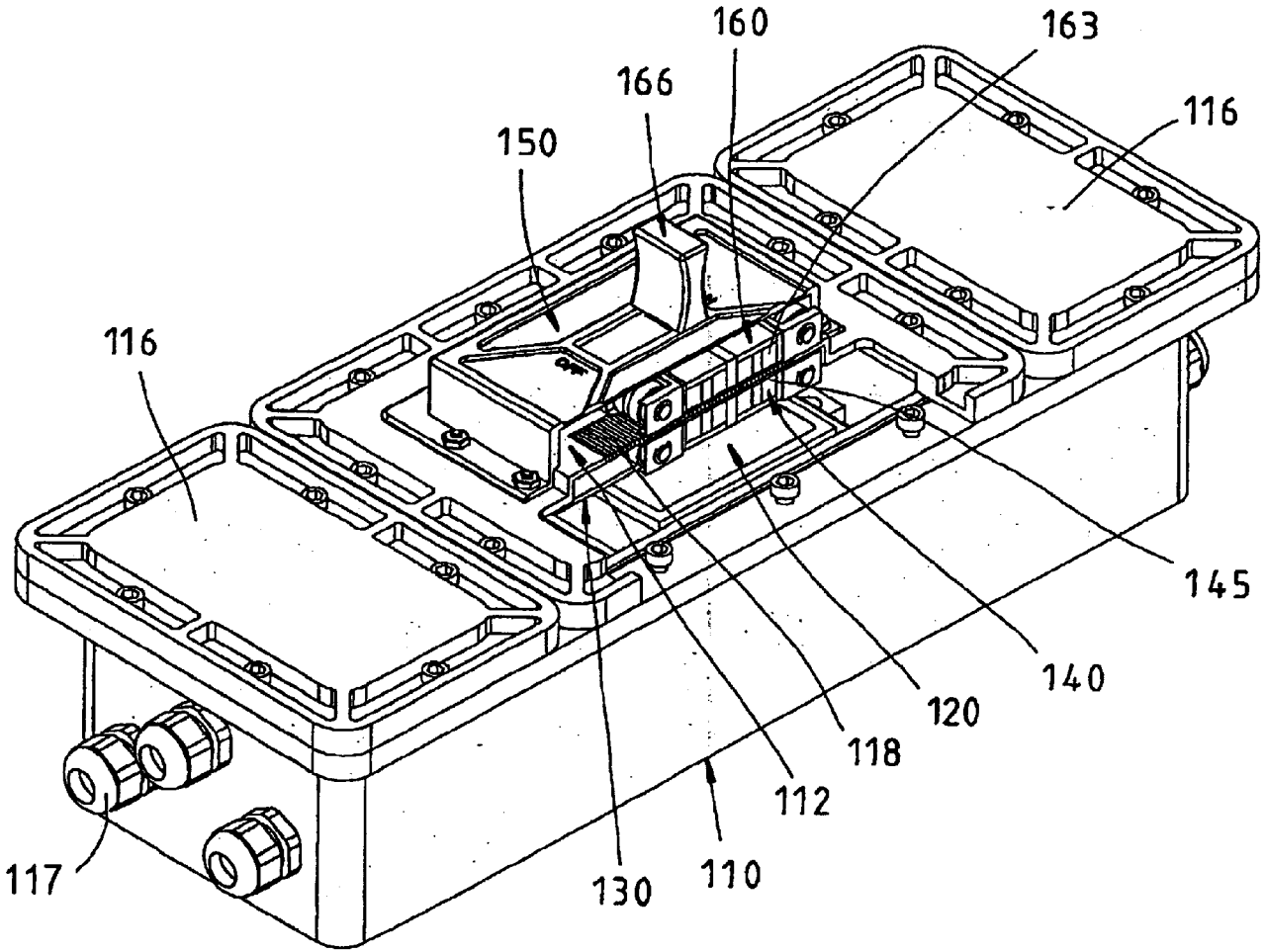
FIG. 3 is a perspective view of the preferred embodiment with a partly sectional view taken along the line 3—3 as shown in FIG. 2.

Referring to FIG. 1 to FIG. 4, a preferred embodiment 100 of a hermetically sealed electrical switch assembly comprises a casing 110 having an opening end at its upside, a cover 112 sealingly attached to said opening end so as to define a hermetically sealed primary volume 114. A conventional electrical switch means 120, for example a conventional circuit breaker, having a switching lever 122 engaged in the primary volume 114. The switching lever 122 can switch between an ON position and an OFF position according to the conducting states of the contacts of the switch means 120. In the embodiment, the switch means 120 is arranged such that the switching direction of the switching lever 122 is along the elongated direction of the casing 110.

The casing 110 also has two side volumes 115 at the two opposite sides of the primary volume 114 respectively. Each of the two side volume 115 is sealingly covered by a side cover 116 respectively. A conducting board (not shown) is engaged in the side volume 115. A plurality of connectors 117 are mounted on each lengthwise wall of the casing 110 and connected with the conducting board for connecting the external circuit. The switch means 120 respectively has a plurality of terminals 124 at two opposite sides thereof which are connected to the conducting board.

A plate retainer 130, which is made of non-magnetic material, such as stainless steel, aluminum alloy or plastic steel, mounts on the under surface of the cover 112. The retainer 130 has a depressed room 131 at the upside thereof for defining a first chamber when it is mounted on the cover 112. The center portion of the depressed room 131 has an elongated guiding opening 132. The switching lever 122 extends to the depressed room 131 via the guiding opening 132.

Figure 4:
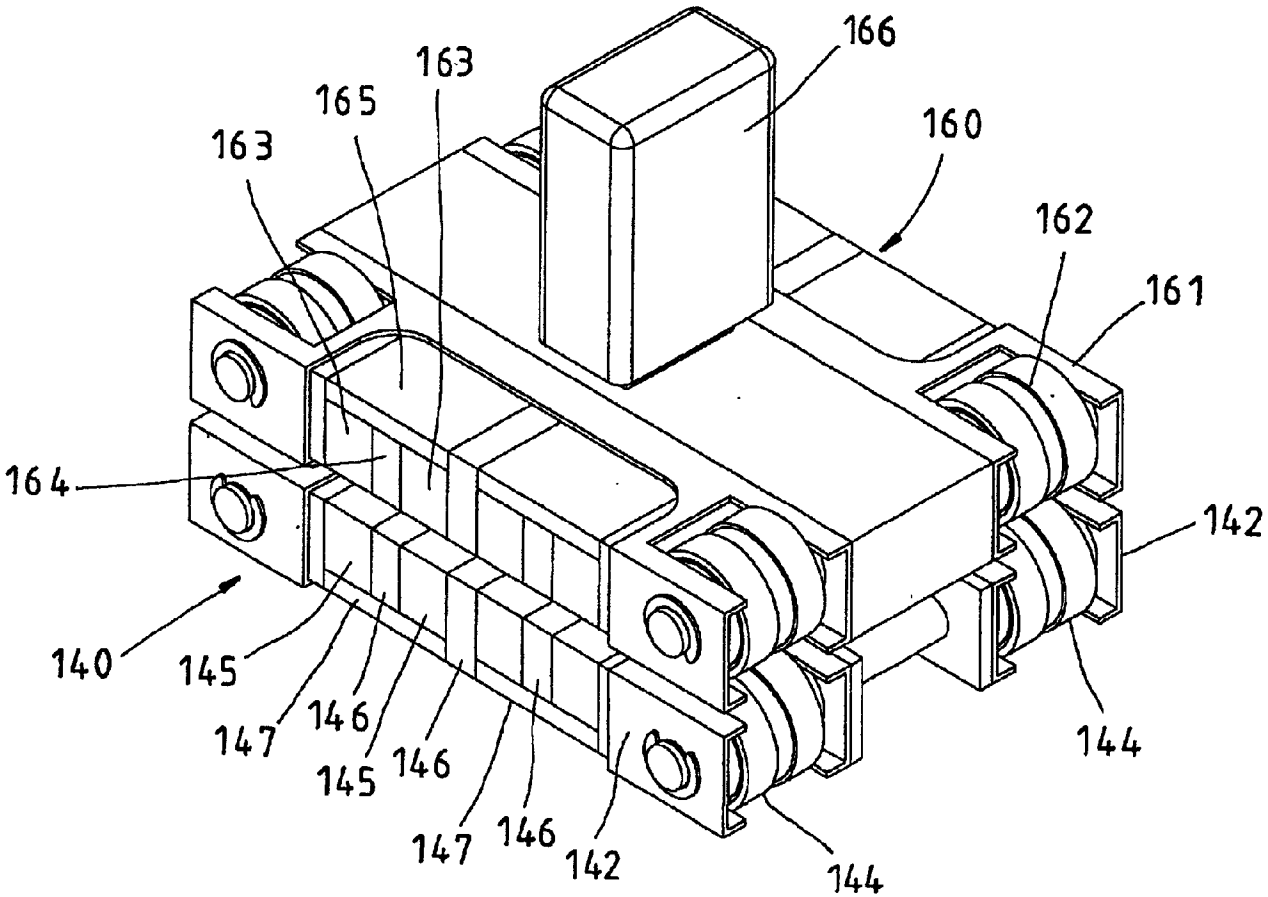
FIG. 4 is a schematic view of said magnetic responsive and activating means of the preferred embodiment.

A magnetic responsive means 140 is fitted in the first chamber. The magnetic responsive means 140 has an inner body 141, which is constituted by two parallel seat members 142 and two ribs 143 having two ends fixing at each of the seat members 142 respectively. Each of the seat members 142 pivots with two rollers 144 and mounts with four first magnet devices 145. The first magnet devices 145 is a rectangle magnet in the embodiment. Referring to FIG. 4, between each of the two first magnet devices 145 disposes with a block 146 respectively. The blocks 146 are made of nonparamagnetic material. Each of the seat members 142 further has two paramagnetic strips 147 disposed at the bottom sides of the seat members 142 with each of which attaching across two of the first guiding devices 145 respectively. Thus, eight first magnet devices 145 and four paramagnetic strips 147 will constitute four independent U-shaped magnets. Certainly, the above-described structure can be directly constituted by two U-shaped magnets mounted at each seat member 142.

The ribs 143 of the inner body 141 forming a space therebetween. The switching lever 122 is wedged in the space for moving with the magnetic responsive means 140 together.

A capping 150 attaches to the upper side of the cover 112 for defining a second chamber. The capping 150 has an elongated opening 151 corresponding to the guiding opening 132. The capping 150 is respectively marked "ON" and "OFF" near the opposite ends of the opening 151 corresponding to the ON position and the OFF position of the switching lever 122 of the switch means 120.

A magnetic activating means 160, referring to FIG. 4, has an outer body 161. The outer body 161 pivots with a roller 162 at four corners thereof. Each of the outer body 161 mounts with four second magnet devices 163 respectively. Just like the magnetic responsive means 140, the second magnet device 163 is also a rectangle magnet in the preferred embodiment. Between each of the two second magnet devices 163 mounts with a block 164 respectively. Four paramagnetic strips 165 dispose at the topside of the outer body 161 being stuck on two of the second magnet devices 163 respectively to form four independent U-shaped magnets with N poles and S poles orientated downward corresponding to the first magnet devices 145 of the magnetic responsive means 140.

The poles of the first magnet devices 145 are opposite to the poles of the corresponding second magnet devices 163 for providing a magnetic attractive force. Thus the magnetic responsive means 140 and the magnetic activating means 160 isolated by the cover 112 can slide synchronously.

The magnet activating means 160 receives in the second chamber with a switching handle 166 at the topside of the outer body 161 extending through the opening 151 of the outer cover 150 and the rollers 162 engage with the cover 112. Whereby, the magnet activating means 160 can slide along the opening 151.

In the embodiment, there are two parallel elongated paramagnetic portions 118 disposed in the central portion of the cover 112. The first and second magnet devices 145, 163 are corresponding to the paramagnetic portions 118 of the cover 112 respectively for enhancing the magnetic attractive force therebetween.

The utilization and the principles of the invention are described hereinbelow.

When the circuit is in an over-loaded or short-circuit state, the switching device 122 of the switch means 120 will switch automatically from the ON position to the OFF position. In the meantime, the magnetic responsive means 140 will be forced to slide to the same way and the magnet activating means 160 will be forced to slide synchronously to the "OFF" position by the magnetic attractive force therebetween. In other words, the outer switching handle 166 of the magnet activating means 160 will be switched corresponding to the switching device 122 of the switch means 120 anytime.

When the switch means 120 is desired to be reset after the circuit is opened, User can push the outer switching handle 166 to force the magnet activating means 160 sliding to the ON position. The magnetic responsive means 140 will slide synchronously to the same way by the magnetic attractive force. In the meantime, the switching lever 122 of the switch means 120 will be forced to switch to the ON position. For the same operating principle, when user pushes the switching handle 166 from the "ON" position to the "OFF" position, the switching lever 122 of the switch means 120 will be forced to switch to the "OFF" position.

Figure 5:
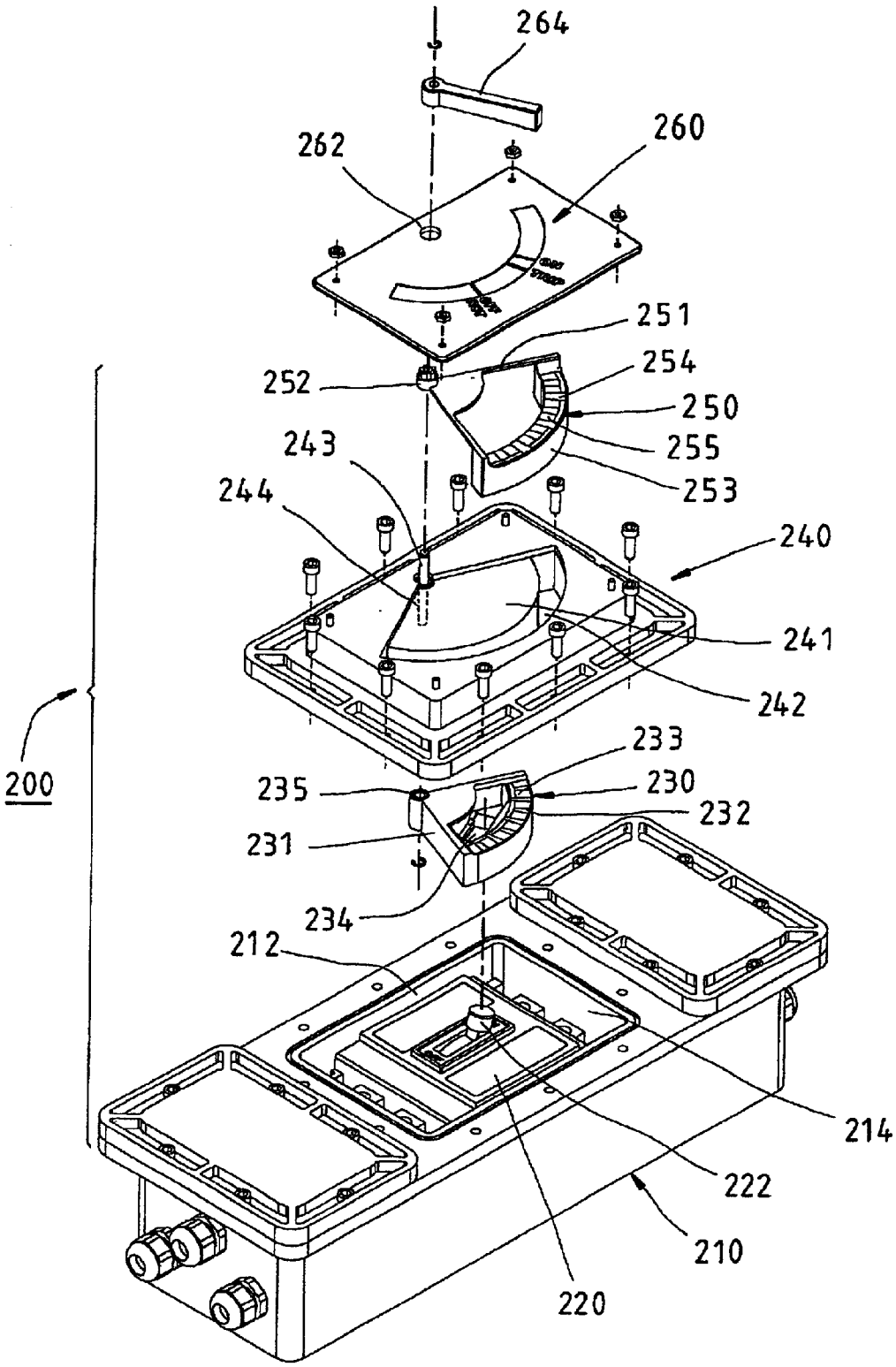
FIG. 5 is a perspective exploded view of a second preferred embodiment of a hermetically sealed electrical switch assembly according the present invention.
Figure 6:
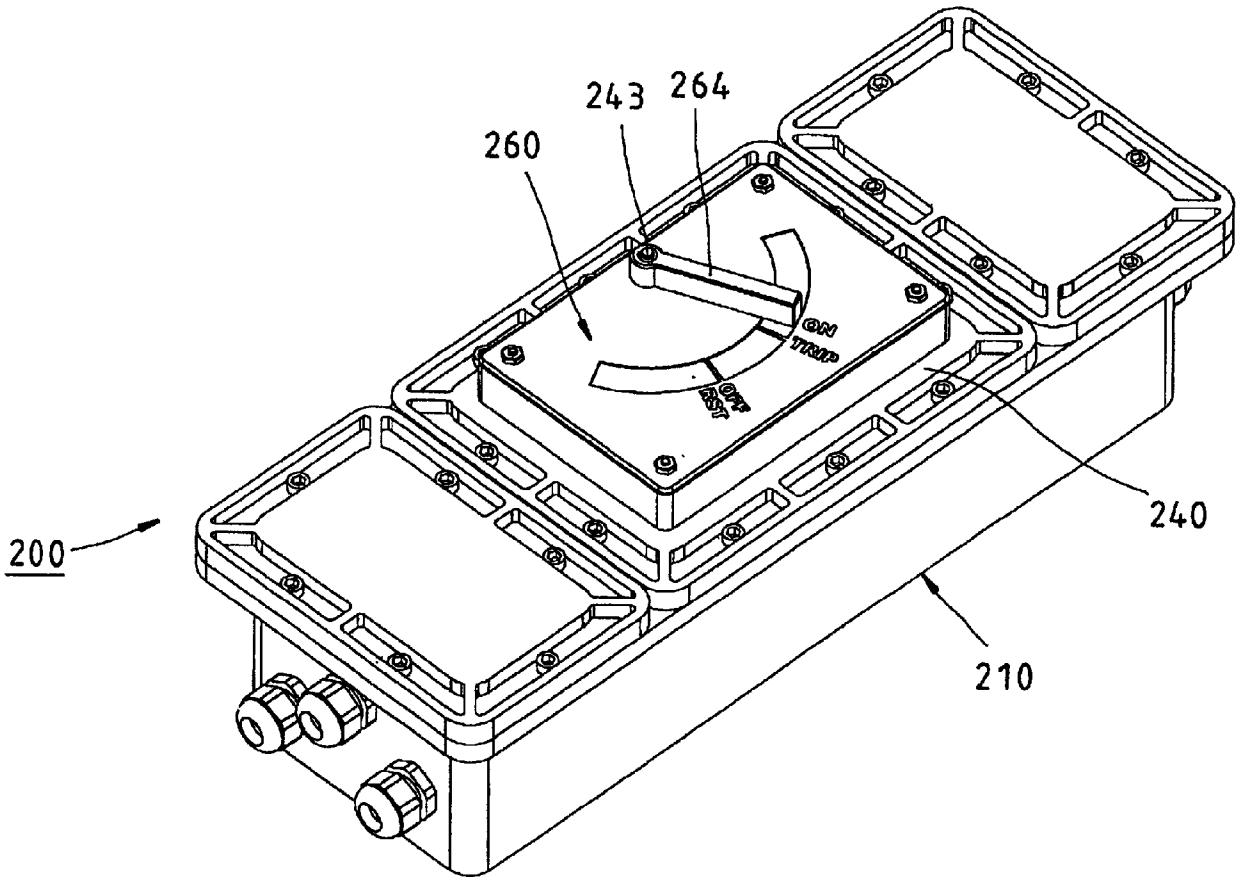
FIG. 6 is a perspective view of the second preferred embodiment.

Now referring to FIG. 5 and FIG. 6, a second preferred embodiment 200 of a hermetically sealed electrical switch assembly, which has a structure similar to the structure of the first preferred embodiment 100, comprises a case 210, an electrical switch means 220, a magnetic responsive means 230, a cover 240 and a magnetic activating means 250.

Hereunder we should describe the structure of the second preferred embodiment 200 different from the first prefer embodiment 100.

The case 210 has a opening end 212 at the top side thereof. The cover 240 attaches to the opening end to define a primary volume 214 hermetically sealed for receiving the electrical switch means 220. The cover 240 disposes at the upside thereof with a sector-shaped guiding room 241 and an arc receiving slot 242 next to the wide end of the guiding room 241. The receiving slot 242 has a deeper depth than the guiding room 241. An outer shaft 243 has one end disposing at the upside of the cover 240 locating at the curvature center of the guiding room 241. An inner shaft 244 has one end disposing at the underside of the main cover 240 corresponding to the outer shaft 243.

The magnetic responsive means 230 has a sector-shaped inner body 231 and a concave room 232 at the wide end thereof. A plurality of first magnetic devices 233 are received in the concave room 232. The first magnetic devices 233 are U-shaped magnets having N poles and S poles orientating upwards. The inner body 231 further has a guiding hole 234 at midsection thereof and a pivoting hole 235 at the curvature center thereof.

The magnetic responsive means 230 receives in the primary volume 214 of the case 210 with the inner shaft 244 of the cover 240 receiving in the pivoting hole 235 for free rotating. The switch means 220 has a switching lever 222 receiving in the guiding hole 234 of the inner body 231 for driving the switching lever 222 to move with the inner body 231. The first magnetic devices 233 are corresponding to the bottom wall of the receiving slot 242 of the cover 240.

A cover plate 260 mounts at the upside of the cover 240 covering the guiding room 241 and the receiving slot 242. The cover plate 260 has a pivoting hole 262 for the outer shaft 243 of the cover 240 extending through. The cover plate 260 marks with "ON" and "OFF" at the upside thereof corresponding to the ON position and the OFF position of the switch lever 222 of the switch means 220.

The magnetic activating means 250 has a sector-shaped outer body 251. The outer body 251 has a pivoting tube 252 at the curvature center thereof and a skirting edge 253 at wide side thereof. The skirting edge 253 has a concave room 254 for receiving a plurality of second magnetic devices 255 having N poles and S poles orientating downwards. The outer body 251 is received in the guiding room 241 with the outer shaft 243 of the cover 240 received in the pivoting tube 252 with the skirting edge 253 received in the receiving slot 242 of the cover 240 for free rotating. The pivoting tube 252 of the outer body 250 passes through the cover plate 260 via the pivoting hole 262. An outer switching handle 264 fixed at the pivoting tube 252 with one end thereof for driving the outer body 251 to turn from outside.

What is claimed is:

1. A hermetically sealed electrical switch assembly comprising:

a casing having an opening end a cover sealingly attached to said opening end of said casing for forming a primary volume hermetically sealed from external environment;

electrical switch means received in said primary volume, having electrical contacts to change the conducting states of a power circuit with which said switch means is connected;

magnetic responsive means arranged inside said primary volume and slideably engaged to both the under surface of said cover and said switch means to move synchronously with said switch means; and magnetic activating means fitted to the upper surface of said cover for effecting the movement of said magnetic responsive means.

2. A hermetically sealed electrical switch assembly as claimed in claim 1, wherein the positions of said magnetic responsive means and said magnetic activating means can be replaced by each other.

3. A hermetically sealed electrical switch assembly as claimed in claim 1, wherein said electrical switch means having a switching lever which can change its positions together with said electrical contacts, said switching lever is connected with said magnetic responsive means.

4. A hermetically sealed electrical switch assembly as claimed in claim 3, wherein said magnetic responsive means comprises an inner body and a first magnet device disposed in said inner body.

5. A hermetically sealed electrical switch assembly as claimed in claim 4, wherein said magnetic activating means comprises an outer body and a second magnet device disposed in said outer body.

6. A hermetically sealed electrical switch assembly as claimed in claim 4 further comprising a retainer mounted on the under surface of said cover for defining a chamber to fit said magnetic responsive means.

7. A hermetically sealed electrical switch assembly as claimed in claim 6, wherein said retainer has an guiding opening, said switching lever protruding through said opening to couple with said inner body.

8. A hermetically sealed electrical switch assembly as claimed in claim 4, wherein said magnetic responsive means further comprises a plurality of rollers respectively pivoted at said inner body.

9. A hermetically sealed electrical switch assembly as claimed in claim 5 further comprising a plurality of rollers respectively pivoted at said outer body.

10. A hermetically sealed electrical switch assembly as claimed in claim 5, wherein said cover has a paramagnetic portion disposed between said first magnetic device and said second magnetic device in order to concentrate the magnetic flux to thus enhance the attractive force therebetween.

11. A hermetically sealed electrical switch assembly as claimed in claim 5 further comprising a capping attached to said cover for defining a second chamber to fit said magnetic activating means.

12. A hermetically sealed electrical switch assembly as claimed in claim 11, wherein said capping has an opening, said outer body having a handle extending through said opening to external environment for users operating said magnetic activating means manually.

13. A hermetically sealed electrical switch assembly as claimed in claim 5, wherein each of said inner and outer body substantially has a shape of a sector of a circle with an apex thereof pivoted in said cover for free rotating synchronously.

14. A hermetically sealed electrical switch assembly as claimed in claim 13, wherein said inner body has a concave room at the wide end thereof for receiving said first magnetic device.

15. A hermetically sealed electrical switch assembly as claimed in claim 13, wherein said inner body has a guiding hole for providing said switching lever of said switch means to pass through.

16. A hermetically sealed electrical switch assembly as claimed in claim 13, wherein said cover has a sector-shaped guiding room at the upper surface therefor for receiving said outer body.

17. A hermetically sealed electrical switch assembly as claimed in claim 16, said outer body having a skirting edge at the wide end thereof, said skirting edge having a concave room for receiving said second magnet device, said cover having an arc receiving slot next to the wide end of said guiding room for receiving said skirting edge of said outer body to correspond to said first magnetic device via the bottom wall of said receiving slot of said cover.

18. A hermetically sealed electrical switch assembly comprising:

a casing having an opening end a cover sealingly attached to said opening end of said casing for forming a primary volume hermetically sealed from external environment;

electrical switch means received in said primary volume, having electrical contacts to change the conducting states of a power circuit with which said switch means is connected;

magnetic responsive means arranged inside said primary volume in the way that it can slidably engage with the under surface of said cover and couple with said switch means for moving synchronously with said switching device; and magnetic activating means fitted to the upper surface of said cover for effecting the movement of said magnetic responsive means and a hermetically sealed electrical switch assembly as claimed in claim 4 further comprising a retainer mounted on the under surface of said cover for defining a chamber to fit said magnetic responsive means.

* * * * *